United States Patent [19]

Koistinen

[11] 4,032,729

[45] June 28, 1977

[54] LOW PROFILE KEYBOARD SWITCH HAVING PANEL HINGED ACTUATORS AND CANTILEVERED BEAM SNAP ACTING CONTACTS

[75] Inventor: Clayton W. Koistinen, La Habra, Calif.

[73] Assignee: Rockwell International Corporation, El Segundo, Calif.

[22] Filed: Dec. 21, 1973

[21] Appl. No.: 427,173

[52] U.S. Cl. ..... 200/5 A; 197/98; 200/1 R; 200/5 R; 200/67 DA; 200/159 A; 200/275; 200/340; 235/145 R

[51] Int. Cl.[2] ..... H01H 13/26; R41J 5/00; G06C 7/02

[58] Field of Search ..... 200/1 R, 5 R, 5 A, 6 BA, 200/67 D, 67 DA, 159 R, 159 A, 159 B, 166 BH, 166 J, 172 R, 275–279, 283, 293, 302, 329–340; 235/145 R; 197/98–103; 340/365; 84/433

[56] References Cited

UNITED STATES PATENTS

| | | | |
|---|---|---|---|
| 3,080,115 | 3/1963 | Buchholz | 200/172 R X |
| 3,205,754 | 9/1965 | Becwar | 84/433 |
| 3,290,439 | 12/1966 | Willcox et al. | 200/5 A X |
| 3,388,226 | 6/1968 | Willcox | 200/67 DA |
| 3,489,342 | 1/1970 | Anderson | 235/145 R |
| 3,548,131 | 12/1970 | Piber | 200/275 X |
| 3,627,935 | 12/1971 | Spievak | 200/5 R |
| 3,707,609 | 12/1972 | Dupot et al. | 200/5 R |
| 3,743,797 | 7/1973 | Hoffman | 200/5 R X |
| 3,786,205 | 1/1974 | Lien | 200/5 A |
| 3,797,357 | 3/1974 | Thomas et al. | 200/1 R X |
| 3,800,104 | 3/1974 | Lien et al. | 200/5 A |

FOREIGN PATENTS OR APPLICATIONS

| | | | |
|---|---|---|---|
| 6,911,191 | 7/1969 | Germany | |
| 2,459,464 | 6/1975 | Germany | 200/159 B |

OTHER PUBLICATIONS

IBM Technical Disclosure Bulletin, R. G. Cross, "Keyboard Overlay", vol. 15; No. 1; June, 1972; p. 31.

*Primary Examiner*—James R. Scott
*Attorney, Agent, or Firm*—H. Fredrick Hamann; G. Donald Weber, Jr.; Roland G. Rubalcava

[57] ABSTRACT

A low profile keyboard switch with tactile feel and short key travel is disclosed. The keyboard may be a matrix connected keyboard and includes a lower, fixed contact and an upper, concave contact. The concave contact is supported at one end and operates as a cantilever beam. When pressure is applied by a key, at the unsupported end to cause buckling of the concave contact at its supported end, electrical contact is made with the lower fixed contact. The concave contacts possess the key return force and the snap action desirable for tactile feel and short key travel for a low-profile, low-cost keyboard switch.

13 Claims, 4 Drawing Figures

LOW PROFILE KEYBOARD SWITCH HAVING PANEL HINGED ACTUATORS AND CANTILEVERED BEAM SNAP ACTING CONTACTS

BACKGROUND OF THE INVENTION

1. Field of the Invention

This invention relates to low-profile keyboard switches and, in particular, to a matrix connected keyboard switch with tactile feel for use in small, low cost devices, such as hand-held calculators.

2. Description of the Prior Art

Existing contacting key switches are available in many variations (see Focus on Keyboards Electronic Design, Nov. 7, 1972, pages 54–64). Recent developments include U.S. Pat. No. 3,732,390, entitled Keyswitch by Phillip J. Novak, which includes a key, a base, a sandwiching body of elastic potting material therebetween that resiliently suspends a floating contact, a fixed contact, a leads associated with each contact extending through the base. When pressure is applied to the key, the elastic material is compressed thereby forcing the floating contact into electrical contact with the fixed contact thus completing the external electrical circuit.

A variation of the key switch is U.S. Pat. No. 3,732,387, entitled Key Switch by William A. Berry which includes a convex-conical shaped key supported by a toroidal, helically wound spring. When the key is depressed through an opening in a printed circuit board, the key expands the helically wound spring causing the spring to make contact with the conductors on the printed board.

Thus, existing key switches with tactile feel mechanisms typically have many component parts, difficult assembly techniques and are generally expensive to produce or maintain.

SUMMARY OF THE INVENTION

This invention relates to an economical, low-profile, keyboard switch assembly with tactile feel provided by a mechanical snap-action from a thin, curved reslient contact. The keyboard switch assembly includes a low profile housing consisting of a lower base frame and an upper cover portion. The lower base frame has grooves for securing the lower contacts and ridges for supporting the upper contacts such that the upper and lower contacts are normally spaced apart and at right angles to one another. The upper contact is an elongated conductor strip which is concave upward and has a series of 'U' shaped apertures therein defining a series of rectangular tongue-like sections. Each of the rectangular sections is supported at one end, in cantilevered fashion, between the lower base frame and the cover portion. The lower contacts consist of relatively flat, elongated conductor strips which have notches along the edges thereof for attaching the strips to the lower base frame. The cover portion may be a keyboard panel which includes one or more keys which may be integral therewith. The cover portion also includes supports which merge snugly into the lower base frame to provide the lower profile keyboard assembly.

Depressing of a key exerts pressure on the associated rectangular section until buckling (or bending) of the rectangular section adjacent the supported end occurs and electrical contact is made with the lower contact spring. External circuitry is responsive to the electrical contact or closed switch. When the key is released, the spring tension provided by the configuration of the upper contact forces the key back to its initial position. The key return force and the "snap" action desirable for tactile feel in this short-travel key system is provided by the elastic buckling of the thin, curved, rectangular section in response to the force exerted by the key.

DESCRIPTION OF THE PREFERRED EMBODIMENT

Figure 1:
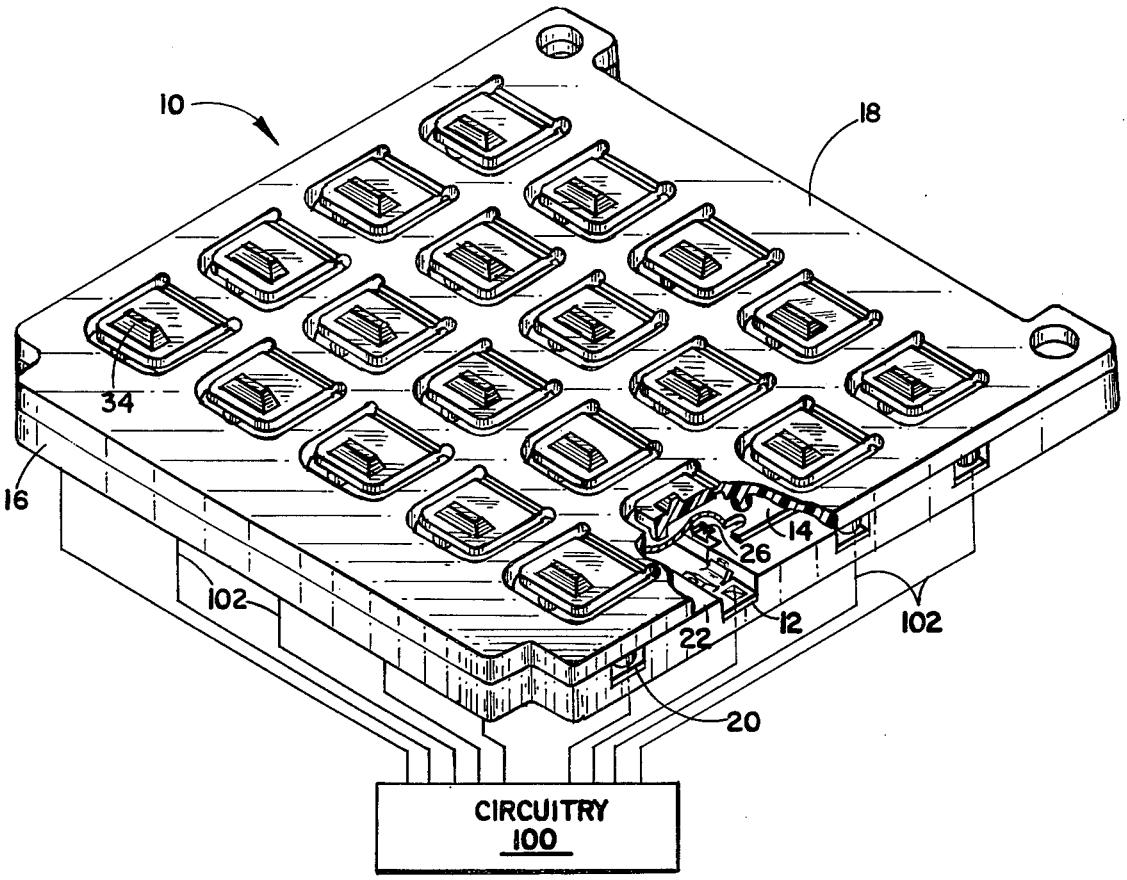
FIG. 1 is a perspective, partially cutaway view of one embodiment of the instant invention.

In the following description, the same reference numeral is used in conjunction with similar components in each of the drawings. However, the suffix A is included in all reference numerals associated with the upper contact member in the depressed state.

FIG. 1 shows a perspective view of keyboard switch housing 10 which has been partially cut away for convenience. The housing 10, which generally is fabricated of a nonconducting material such as plastic, consists of a base frame 16 and a cover portion 18. Base 16 is a relatively ridged member having one or more grooves 20 for retaining lower contacts 12 and ridges 22 for supporting upper contacts 14. The cover 18, which may be a keyboard panel, includes a plurality of individual keys 34. The keys may be of either a plunger type or a swing key which is hinged to the cover.

Typically, lower contacts 12 may comprise a plurality of elongated conductor strips. In one embodiment, these strips may be formed as a part of base member 16. In the alternative, these strips may be separately formed and mounted in grooves 20 in base 16. Grooves 20 have small protrusions 24 which extend generally outwardly from the inside walls thereof. In the latter arrangement, lower contacts 12 are notched to have one or more tabs 28 along one or both edges. Lower contacts 12 are held securely in groove 20 by bracing tabs 28 against protrusions 24, as is more readily seen in FIG. 2. Lower contact 12 serves as the stationary limit stop for the key travel as well as for one switch connection.

Grooves 20 also include indentations 26 along one wall. These indentations graduate down in three steps as shown best in FIG. 2. This configuration of indentations 26 thus provides a substantially downwardly concave cavity. This cavity configuration is of significant assistance in the operation of the switch as described infra. For example, this cavity 26 reduces deleterious effects on contact 30, as discussed hereinafter.

When housing 10 is assembled, upper contact 14 provides one-half of an X–Y matrix arrangement of switches and lower contact 12 provides the other half of the matrix. Lower contact 12 and upper contact 14 may be formed, for example, by stamping from any suitable electrically conductive metal such as strain hardened steel. The contacts can be formed in elongated strips and the lengths can vary as required.

Figure 2:
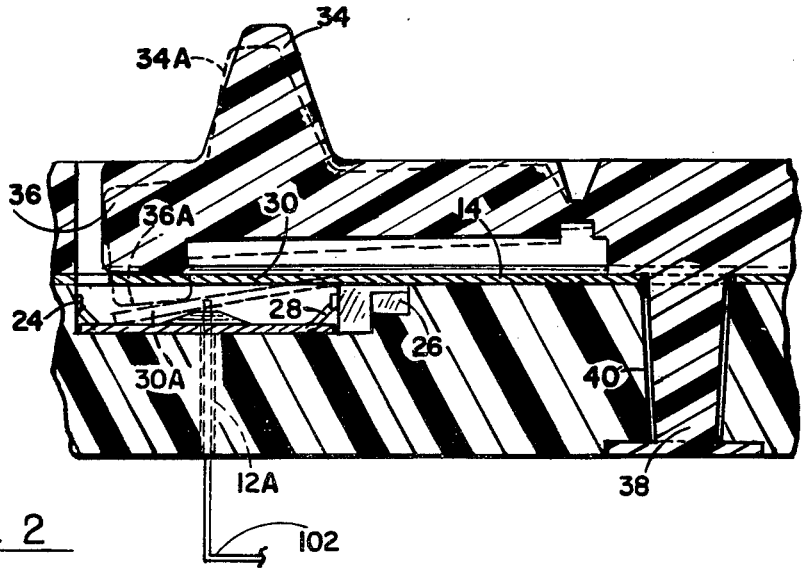
FIG. 2 is an enlarged cross-sectional view of one embodiment of the invention.
Figure 3:
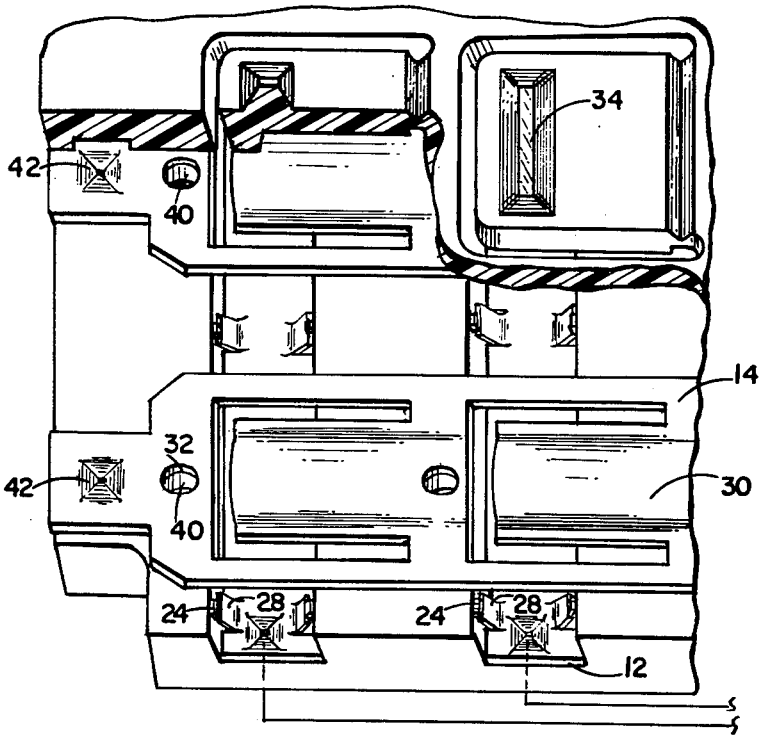
FIG. 3 is a top, partially cutaway of one embodiment of the invention.
Figure 4:
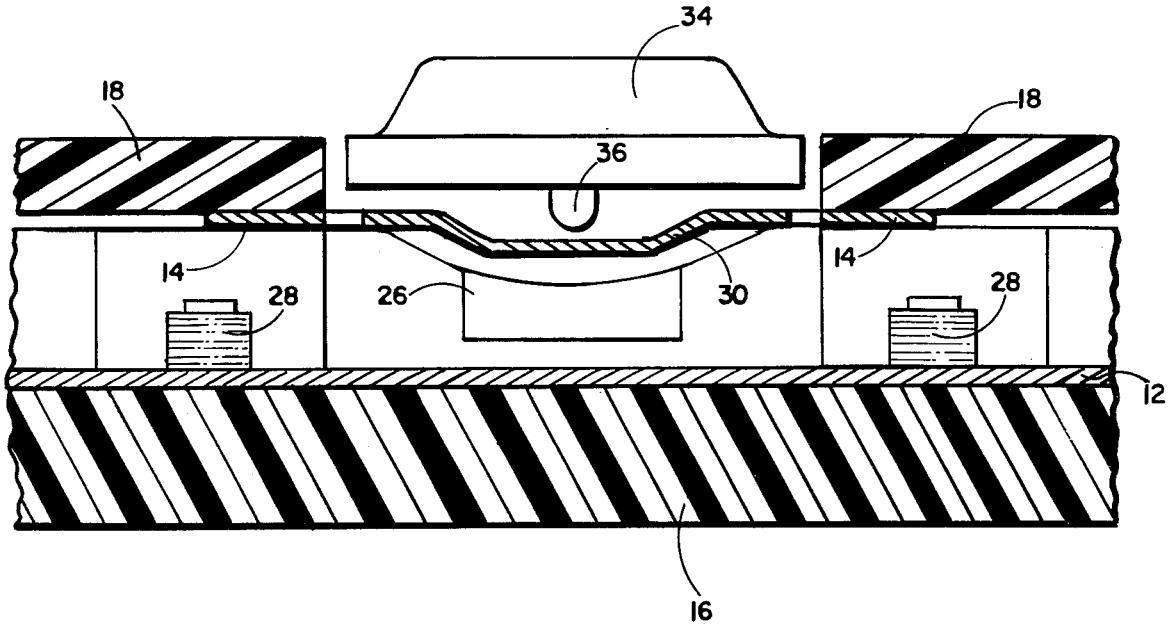
FIG. 4 is cross-sectional view showing the indentation concave configurations with respect to the movable contact.

In the preferred embodiment, upper contact 14 is an elongated blank of relatively thin, resilient material having a curved, i.e., concave, configuration. A plurality of 'U' shaped apertures are formed therein leaving a plurality of rectangular sections 30 at spaced intervals (e.g., about ⅝) along the length thereof as shown in FIG. 3. It should be understood that each rectangular section 30 (or tongue) typically represents a separate switch connection. Upper contact 14 is supported on ridges 22 substantially normal to grooves 20 such that the upper and lower contacts cross at right angles. To assure proper orientation of upper contact 14, holes 32 in upper contact 14 are aligned with the holes 40 in ridges 20. Support posts 38 (see FIG. 2) are fitted through holes 32 and 40 until the cover 18 is aligned and merged snugly with bas 16 to provide a low-profile keyboard assembly without printed circuit boards or elastic material therebetween and with each contact separately spaced from each other.

When upper contact 14 is secured by support posts 38, rectangular section 30 is capable of supporting key 34. Plunger 36 of key 34 may actually rest upon the upper concave surface of rectangular section 30 as shown in FIG. 2. Rectangular sections 30 are aligned over the edge of indentations 26 and function as a loaded cantilever beam. Thus, when key 34 is depressed into the position suggested by dashed outline 34A, plunger 36 exerts a force on the rectangular section 30 until buckling thereof occurs at the supported end adjacent indentation 26. When tongue 30 buckles, it assumes the position shown by dashed outline 30A whereby the rectangular section 30A makes contact with lower contact 12 as shown in FIG. 2. When key 34 is released, the spring tension provided by upper contact 14 forces key 34 back to its initial position. The key return forces and the "snap" action desirable for tactile feel in this short travel key system are provided by the elastic buckling of the thin, curved, rectangular section 30 when under the influence of the concentrated load supplied by key 34.

Since fatigue failure is attributable to the direct bending stress applied to a contact spring prior to buckling and not to the buckling and not to the buckling deformation, the geometry of upper contact 14, the configuration of indentation 26 and the position of contact 14 relative to indentation 26 are important to minimize the direct flexural stress with minimum impact on the buckling load of the contact. The illustrated embodiment represents what is believed to be the optimum configuration. This switch configuration has been operated in excess of $10^7$ cycles without failure of a contact spring. Hence, the configuration of indentation 26 which graduates down in three steps with a concave effect, is important to controlling the break of rectangular section 30 over the corners of indentation 26 when the applied force by key 34 causes buckling of section 30. The initial required force for depressing key 34 is sufficient to avoid accidental entry when the operator rests his fingers on the keyboard. When the force on the key is increased sufficiently to cause buckling of rectangular section 30, the spring force required to hold key 34 in its normal position is overcome. Thus, the collapse of the spring and depression of the key are manifested to the operator as "tactile feel". This firm contact closure action results in a relatively smoother, free switch system not vulnerable to inadvertent double entry and related keyboard malfunctions. This configuration was also experimentally found to substantially reduce the noise factor over those configurations that do not utilize indentations with the concave effect. Indentation 26 which steps down in three steps with a concave effect to the inner surface of groove 20 may be used to vary the load required to cause buckling of rectangular section 30.

In the preferred embodiment, indentation 26 is positioned such that the corners of indentation 26 support rectangular section 30 at points on each side of the centerline of the concave portion of rectangular section 30 and normally at the intersection of the neutral axis thereof. Relocation of rectangular section 30 such that the corners of indentation 26 are closer to the centerline of rectangular section 30 reduces the buckling load while relocation away from the centerline increases the buckling load.

In the preferred embodiment, the contact material may consist of type 302 corrosion-resitant, strain-hardened spring steel. This material has good spring properties and electrical contact resistance which is sufficiently low to be useful in MOS circuitry. Typically key 34 is supported at its normal position by the spring tension of curved rectangular section 30. Of course, in a hinged key configuration, the hinge will also provide support for the key. In a preferred embodiment, upper contact 14 is approximately ½ in width and 3 mils thick and the length varies depending on the number of switches desired. Lower contact 12 may also be formed from stainless steel but is generally, substantially flat. As force is applied to key 34, rectangular section 30 resists the motion of plunger 36 as a stiff spring, until a critical stress is reached in the spring material, at which time elastic buckling of rectangular section 30 occurs at the supported end over indentation 26. The force required to continue motion is less than the force required to cause buckling, resulting in the snap action. Motion continues until the rectangular section 30 assumes position 30A, strikes lower contact 12, makes the electrical connection and stops key 34.

When electrical contact between lower contact 12 and rectangular section 30 is made, external circuitry 100 senses that a switch has been closed and operates upon this information. Electrical connection to the external circuitry is accomplished by inserting pins or wires 102 through holes 12A in base 16 and through lanced holes 42 at the ends of each contact. Lanced holes 42 have pyramid shaped edges which grip the wires or pins 102 securely thereby eliminating the necessity of a solder operation. Wires or pins 102 can be removed from the mechanical joint by pulling sharply and may be reinserted several times without degradation of the joint. Of course, a solder joint can be used if desired. Upon release of key 34, the spring tension provided by rectangular section 39 forces key 34 back to its initial position.

As a result of the modular design, the parts of this assembly may be manufactured and assembled in large quantities. Thus an assembly is provided which is economically feasible without sacrificing the "tactile feel" or the "firm contact" required in low profile short key travel systems. The embodiment shown and described is illustrative only. It is not meant to be limitative of the invention. Rather, the scope of the invention is to be defined by the claims appended hereto.

What is claimed is:

1. A keyboard switch assembly comprising:

at least one elongated stationary lower contact member;

at least one elongated upper contact member;
said upper contact member having a substantially concave configuration;
a housing including a base member and a cover member;
said cover member engaging said base member;
said base member having at least one groove for securing said lower contact member;
said base member including ridges adjacent each groove for supporting said upper contact member transferse to said lower contact member;
said ridges having indentations along at least one wall thereof;
each upper contact member having at least one movable section which is supported at one end as a cantilevered beam;
said movable section being aligned with an associated indentation; and
key means supported by said cover member for selectively forcing said movable section to buckle at the supported end thereof over the associated indentation and causing the end of said movable section to make electrical contact with said lower contact member.

2. The keyboard switch assembly recited in claim 1 wherein the indentations in said ridges of said base member are graduated and have a substantially concave configuration; and
said ridges further include holes for receiving support posts on said cover member for engaging said base member and said cover member.

3. The keyboard switch assembly recited in claim 2 wherein said upper contact member includes holes through which said support posts are fitted adjacent said supported end of said movable section in order to secure said upper contact member and to assure said supported end of said movable section is positioned over the edge of the associated indentation.

4. The keyboard switch assembly recited in claim 1 including external electrical circuitry, and conductor means connected from said lower contacts and said upper contacts to said external circuitry.

5. The keyboard switch assembly recited in claim 1 wherein said key means is integrally formed with said cover member in at least one pivotal location.

6. The keyboard switch assembly recited in claim 5 wherein said key means includes:
a. a plurality of integrally formed keys defined therein, each key having a button portion protruding above the surface of said cover member opposite said cover surface and being separated from the remainder of said cover member around three sides of said button portion, said upper surface of said cover member is generally planar except for said protruding button portions of said keys, and wherein said base member has one lower surface also generally planar, said keys having lower surfaces generally spaced upwardly from said one lower planar surface of said base member and having said depending portions located in the place of said one lower surface of said base member, and each key also having a depending portion for engaging said movable section to make contact with said lower contact member.
b. an intermediate lower portion of each of said keys integrally formed with each key, the lever portion of each key having a selected thickness and being connected at one end to the button portion of the key and laterally extending from one side of said button portion of said key and,
c. a self-hinge portion of each of said keys integrally formed with each key, the self-hinge portion of each key having a relatively lesser thickness than said lever portion of said key integrally connecting an opposite end of said lever portion to the remainder of said keyboard member, whereby each key is readily deflected against said movable section to make electrical contact with said lower contact member.

7. The keyboard switch assembly recited in claim 1 wherein said upper contact member has a concave configuration and said lower contact member is substantially flat.

8. The keyboard switch assembly recited in claim 1 including projections from the sidewalls of said groove in said base member for retaining said lower contact member in said groove.

9. The keyboard switch assembly recited in claim 1 comprising
a plurality of said lower contact members arranged in parallel grooves in said base member; and
a plurality of said upper contact members supported on said ridges in said base member such that said upper and lower contact members are arranged orthogonally to each other to provide a matrix type array.

10. A keyboard switch assembly as recited in claim 8 for selectively actuating said matrix type array, said keyboard switch assembly including:
a. a locating portion for mounting said cover member in overlaying relation to said base member, and
b. a plurality of integral keys disposed in selected spaced relation to each other, each of said keys being defined by a slit in said member extending around three sides of said key for permitting the key to be deflected for engaging said movable section, each of said keys having a push button portion, a depending portion for engaging said movable section, an integral lever portion of selected length and thickness extending from one side of said push button portion, and a self-hinged portion of relatively lesser thickness than said lever portion integraly connecting said lever portion to the remainder of said member for supporting said key on said member, said push button portions of said keys protruding above said lever portions of said keys for permitting said keys to be uniformly deflected by depressing of said buttons.

11. The keyboard switch assembly recited in claim 1 wherein said indentations are graduated in a plurality of steps and have a relatively concave configuration to mate with the concave configuration of said upper contact member.

12. The keyboard switch assembly recited in claim 1 wherein said upper contact member is fabricated of an electrically conductive material, and
said movable section of said upper contact member comprises a tongue-like member which has one end thereof intergrally formed with said upper contact member and three sides thereof separated from said upper contact member so that said movable section remains in a first position until deformed by force applied by said key means.

13. A keyboard switch assembly as recited in claim 1 wherein said key means includes a keyboard member, said keyboard member having a plurality of integral keys each defined by a slit in said member extending around three sides of said key for permitting said key to be deflected, said keys being disposed in selected spaced relation to each other to be engaged with respective contact members for actuating said moveable section when said keys are deflected, each of said keys having a push button portion, a depending portion for engaging said respective contact member, an integral lever portion of selected length and thickness extending from one side of said push button portion, and a self-hinge portion of relatively lesser thickness than said lever portion integrally connecting said lever portion to the remainder of said member for supporting said key on said member, said push button portions of said keys protruding above said lever portions of said keys for permitting said keys to be uniformly deflected by depression of said push buttons.

* * * * *